US011707146B2

(12) United States Patent
Henderson et al.

(10) Patent No.: US 11,707,146 B2
(45) Date of Patent: Jul. 25, 2023

(54) PINEAPPLE DRINKING VESSEL AND RELATED METHODS

(71) Applicants: James M. Henderson, San Marcos, CA (US); Kristine M. Kennedy, Temecula, CA (US)

(72) Inventors: James M. Henderson, San Marcos, CA (US); Kristine M. Kennedy, Temecula, CA (US)

( * ) Notice: Subject to any disclaimer, the term of this patent is extended or adjusted under 35 U.S.C. 154(b) by 54 days.

(21) Appl. No.: 17/222,009

(22) Filed: Apr. 5, 2021

(65) Prior Publication Data

US 2021/0369021 A1 Dec. 2, 2021

Related U.S. Application Data

(60) Provisional application No. 63/033,111, filed on Jun. 1, 2020.

(51) Int. Cl.

| | |
|---|---|
| ***A47G 19/22*** | (2006.01) |
| *A47G 23/02* | (2006.01) |
| *B65D 25/28* | (2006.01) |

(52) U.S. Cl.

CPC ..... *A47G 19/2227* (2013.01); *A47G 19/2255* (2013.01); *A47G 23/0216* (2013.01); *A47G 2400/105* (2013.01); *B65D 25/2817* (2013.01); *B65D 25/2829* (2013.01)

(58) Field of Classification Search

CPC ..... B65D 23/106; B65D 23/104; B65D 25/2817; B65D 25/2829; B65D 2525/287; B65D 2525/285; A47G 2400/105; A47G 23/0216; A47G 23/0241; A47G 19/2227; A47G 19/2255; A47G 2023/0291; A47G 2023/0283

See application file for complete search history.

(56) References Cited

U.S. PATENT DOCUMENTS

| | | | | | |
|---|---|---|---|---|---|
| 902,236 | A * | 10/1908 | Kintz | B65D 23/106 | 215/396 |
| 1,464,789 | A * | 8/1923 | Ward | A47G 23/0241 | 215/396 |
| 1,959,857 | A * | 5/1934 | Davis | A47G 23/0216 | 215/396 |
| 2,010,317 | A * | 8/1935 | Olson | A47G 23/0266 | 220/759 |
| 2,396,479 | A * | 3/1946 | Votaw | A47G 23/0266 | 294/34 |

(Continued)

FOREIGN PATENT DOCUMENTS

| | | | | |
|---|---|---|---|---|
| DE | 202005019447 U1 * | 4/2006 | B65D 23/106 | |
| DE | 202006016249 U1 * | 2/2007 | A47G 23/0258 | |

(Continued)

OTHER PUBLICATIONS

KR_200334865_translation.pdf.*

*Primary Examiner* — Allan D Stevens
(74) *Attorney, Agent, or Firm* — Timothy W. Fitzwilliam

(57) ABSTRACT

A handle attachable to a cored-out pineapple is disclosed herein, resulting in a unique drinking vessel, particularly, as preparation of a tropical style drink. The solution provides for secure affixation as well as easy attachment and removal. Additionally, an efficient method for attaching a handle to a pineapple or other hollowed out fruit is also introduced herein.

8 Claims, 5 Drawing Sheets

(56) References Cited

U.S. PATENT DOCUMENTS 2,559,190 A * 7/1951 Hallstream ..... A47G 23/0266 294/34
2,801,743 A * 8/1957 Geen ..... A47G 23/0258 215/396
2,979,225 A * 4/1961 Noffsinger ..... A47G 23/0258 D7/622
3,107,028 A * 10/1963 De Robertis ..... A47G 23/0216 215/396
3,825,151 A * 7/1974 Arnaud ..... A47G 23/0216 220/759
4,823,975 A * 4/1989 Schwankl ..... A47G 23/0266 294/34
4,993,675 A * 2/1991 Walker ..... A47G 23/0266 220/759
5,013,074 A * 5/1991 Galle ..... A47G 23/0241 215/396
5,025,940 A * 6/1991 Akly ..... B65D 23/106 215/396
5,413,231 A * 5/1995 Carroll ..... B65D 23/106 220/759
6,149,028 A * 11/2000 Yu ..... A47G 23/0216 220/741
6,729,665 B1 * 5/2004 Posey ..... B65D 23/106 215/396
D509,992 S 9/2005 Lipson
7,284,777 B1 * 10/2007 Kraemer ..... B65G 7/12 294/165
7,909,202 B1 * 3/2011 Gordon ..... B65D 23/106 220/742
D743,743 S 11/2015 Sanbar
9,469,439 B1 * 10/2016 Polsinelli ..... A47G 23/0241
2004/0135049 A1 * 7/2004 Kent-Fawkes ..... B65D 23/106 248/312.1
2009/0065469 A1 * 3/2009 McClellan ..... A45F 5/102 215/390
2016/0066728 A1 * 3/2016 Sabag ..... A47G 23/0216 220/769
2017/0129277 A1 * 5/2017 Rogowski ..... B65D 25/22
2019/0055061 A1 * 2/2019 Hughes ..... B65D 23/106
2021/0113004 A1 * 4/2021 Romley ..... A47G 23/0233

FOREIGN PATENT DOCUMENTS

DE 102014000315 A1 * 7/2015 ..... B65D 23/106
GB 2461034 A * 12/2009 ..... A47G 23/0241
JP H07291292 A * 11/1995
KR 200201197 Y1 * 11/2000
KR 200334865 Y1 * 12/2003
KR 20080067056 A * 7/2008
KR 20180050495 A * 5/2018
WO WO-2005048770 A1 * 6/2005 ..... A45F 5/10

* cited by examiner

PINEAPPLE DRINKING VESSEL AND RELATED METHODS

PRIORITY CLAIM

This patent application claims benefit of the priority date of U.S. Prov. Pat. App. Ser. No. 63/033,111 filed on Jun. 1, 2020 entitled "Pineapple Drinking Vessel and Related Methods." Accordingly, the entire content of this U.S. provisional patent submission is hereby expressly incorporated by reference.

BACKGROUND OF THE INVENTION

Field of the Invention

The present invention pertains generally to tropical drinks, for example, cocktail creations served in Tiki bars; specifically, in a preferred embodiment, the present invention relates to a handle attached to a cored-out pineapple.

Description of the Prior Art

Heretofore, cocktails of a tropical nature or umbrella drinks have been known since about the early or mid $20^{th}$ century. More recently, smoothies have gained in popularity as drinks of a tropical nature, however non-alcoholic.

Also known in realm of umbrella drinks are cored out pineapples converted to drinking vessels. A notable example has been provided by Lipson, U.S. Des. Pat. No. D509,992 entitled "Pineapple Drink Container," and was awarded patent protection in 2005. More recently." in the last decade, Sanbar introduced a similar design entitled, "Pineapple Cup," U.S. Des. Pat. No. D743,743. While these concepts may provide an aesthetically pleasing appearance for a tropical style drink, they're impractical and do not make the drinking cup easier to handle. Specifically, with regard to pineapples, a prickly outer surface has to be contended with. Also, they're slightly bigger and heavier than typical cups or mugs. And with the mention of a desire to drink from a mug, no solution provides a means of attachment of a handle to a cored pineapple creating a mug.

In light of the aforementioned, it is an object of the present invention to provide a handle attachment apparatus that can easily affixed to a pineapple while remaining firmly in place. Yet further, it is an object of the present invention to provide a method of attaching a handle to a cored pineapple.

BRIEF SUMMARY OF THE INVENTION

The present invention specifically addresses and alleviates the above-mentioned deficiencies, more specifically, the present invention, in a first aspect is a drinking vessel comprising: an individual hollowed out produce including a top surface being cut to a predetermined height; a vertical stanchion positioned and secured at a lateral side of the individual produce; and a handle attached to the vertical stanchion thereby making the drinking vessel a mug-type drinking vessel. In a preferred embodiment the predetermined height is approximately 5 inches.

The invention in this aspect is additionally characterized as having a U-channel inverted at a top of the vertical stanchion, the U-channel configured around a brim of the individual produce at the top surface. Also included is a base plate configured at a bottom of the vertical stanchion; a plurality of spikes configured on a top surface of the base plate for gripping a bottom surface of the individual produce. As preferred, the plurality of spikes are angled in a direction towards the vertical stanchion to permit sliding in the direction while remaining secure in a reverse direction.

The invention in this first aspect is further characterized in that the U-channel has an arm extending down an inside wall of the individual produce, the arm having a curved end for mating adjacent to the inside wall, the curved end having a spike to secure to the inside wall. Optionally, the drinking vessel may include a strap extending circumferentially around the individual produce and the vertical stanchion at an upper portion thereof. Also more particularly, the handle and vertical stanchion each comprise an upper and a lower horizontal span offsetting said handle and said vertical stanchion.

In a second aspect the invention is characterized as drinking vessel comprising: a hollowed out cored pineapple being open to receive liquid at an open top surface; an attachment apparatus having upper and lower halves, the attachment apparatus comprising: a hook at the upper half; a base plate at the lower half; and a vertical stanchion therebetween wherein the vertical stanchion comprises upper and lower halves fitting together and securing the pineapple at the top surface and a bottom surface.

The attachment apparatus of the invention in this aspect is further characterized as having its upper and lower halves telescoping thereby providing the attachment apparatus adjustable for varying heights of the pineapple. Also, the attachment apparatus further comprises a handle offset from the vertical stanchion thereby making the drinking vessel a mug-type drinking vessel.

In still a third aspect, the invention is characterized as a method of making a drinking vessel, comprising the method steps of: providing a pineapple; cutting the pineapple to an appropriate height; coring out the pineapple; affixing a vertical stanchion to a lateral side of the pineapple; attaching a handle to the vertical stanchion thereby making the drinking vessel a mug-type drinking vessel.

Still further in the third aspect, the invention is characterized wherein the cutting the pineapple to an appropriate height comprises a step of cutting the pineapple at 5 inches. Also more specifically, the affixing a vertical stanchion to a side of the pineapple comprises the method steps of: providing a U channel at a top of the vertical stanchion configured to fit around the brim of the pineapple; and providing a base plate at a bottom of the stanchion, the U channel together with the base plate supporting the pineapple at opposite ends thereby holding the vertical stanchion and handle in place.

While the apparatus and method has or will be described for the sake of grammatical fluidity with functional explanations, it is to be expressly understood that the claims, unless expressly formulated under 35 USC § 112, or similar applicable law, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC § 112 are to be accorded full statutory equivalents under 35 USC § 112, or similar applicable law. The invention can be better visualized by turning now to the following drawings wherein like elements are referenced by like numerals.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DETAILED DESCRIPTION OF PREFERRED EMBODIMENTS

Figure 1A:
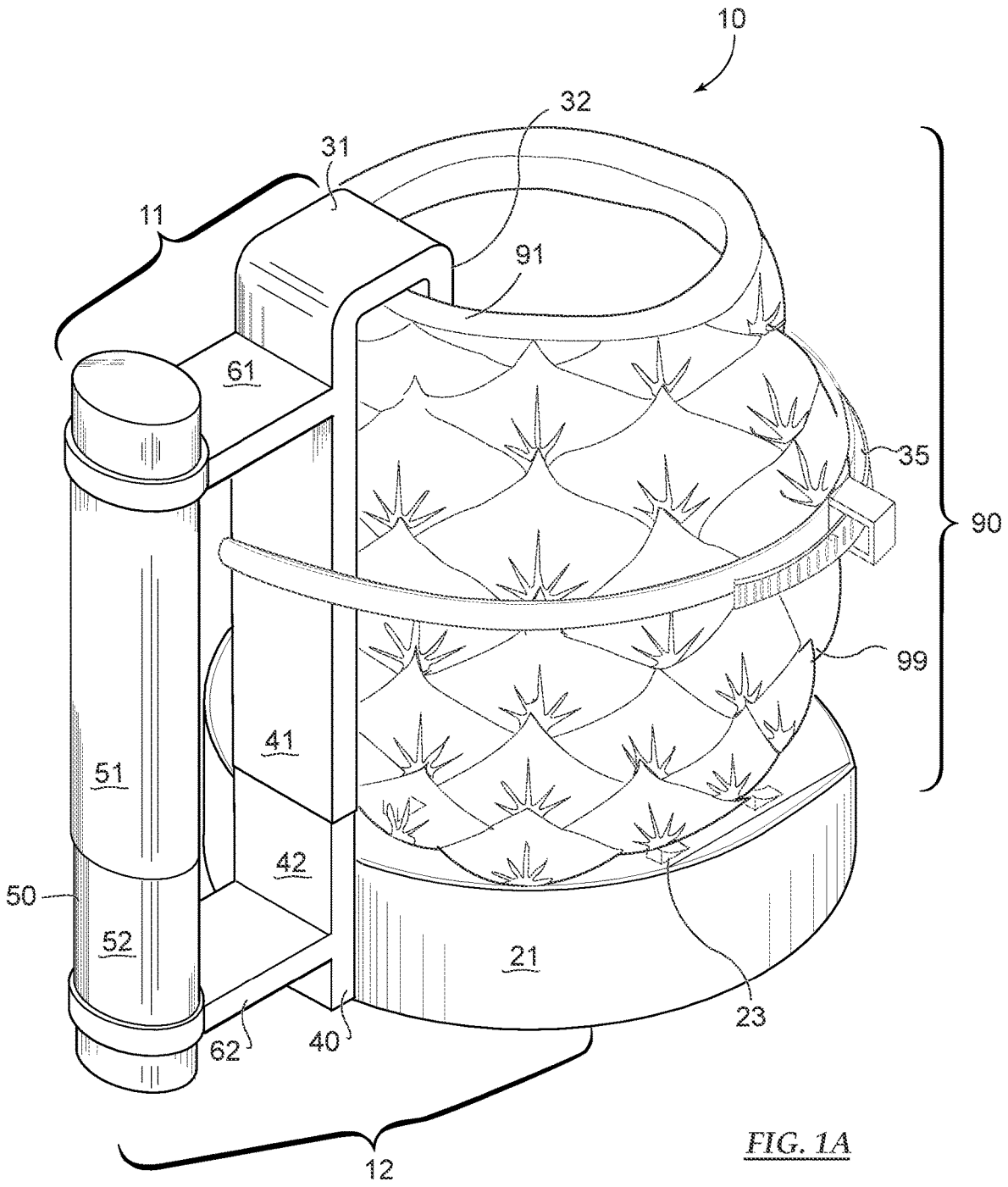
FIG. 1A is an isometric view of a first preferred drinking vessel of the present invention.

Initially with regard to FIG. 1A, the drinking vessel 10 invention in a first aspect is a handle 50, such as that on a beer mug, having additional structure providing attachment means, i.e. attachment apparatus comprising base plate 21, U channel 30, and vertical stanchion 40, to a cored-out pineapple 99. Also, importantly in another aspect, the invention is a method of making a drinking vessel 10 from a pineapple 99 initially comprising the steps of cutting off a top of the pineapple to an appropriate height 90; and subsequently coring out the pineapple 99 so that it may hold liquid. It should be appreciated that herein, throughout, a pineapple could be substituted with another fruit or produce, defined herein as a fruit or vegetable, able to be cored or hollowed out.

Additionally with regard to FIG. 1A together with FIG. 1 B, a pineapple 99 could slide in under the U channel 30 with an optional strap 35 subsequently secured around a circumference of the pineapple. Or the attachment apparatus having a handle 50 offset therefrom, could comprise an upper half 11 and a lower half 12 that clamp down on the pineapple 99. Essentially in this way, the upper half 11 is an upper abutment to the pineapple, together with a lower half 12 sandwiching the pineapple 99.

Figure 1B:
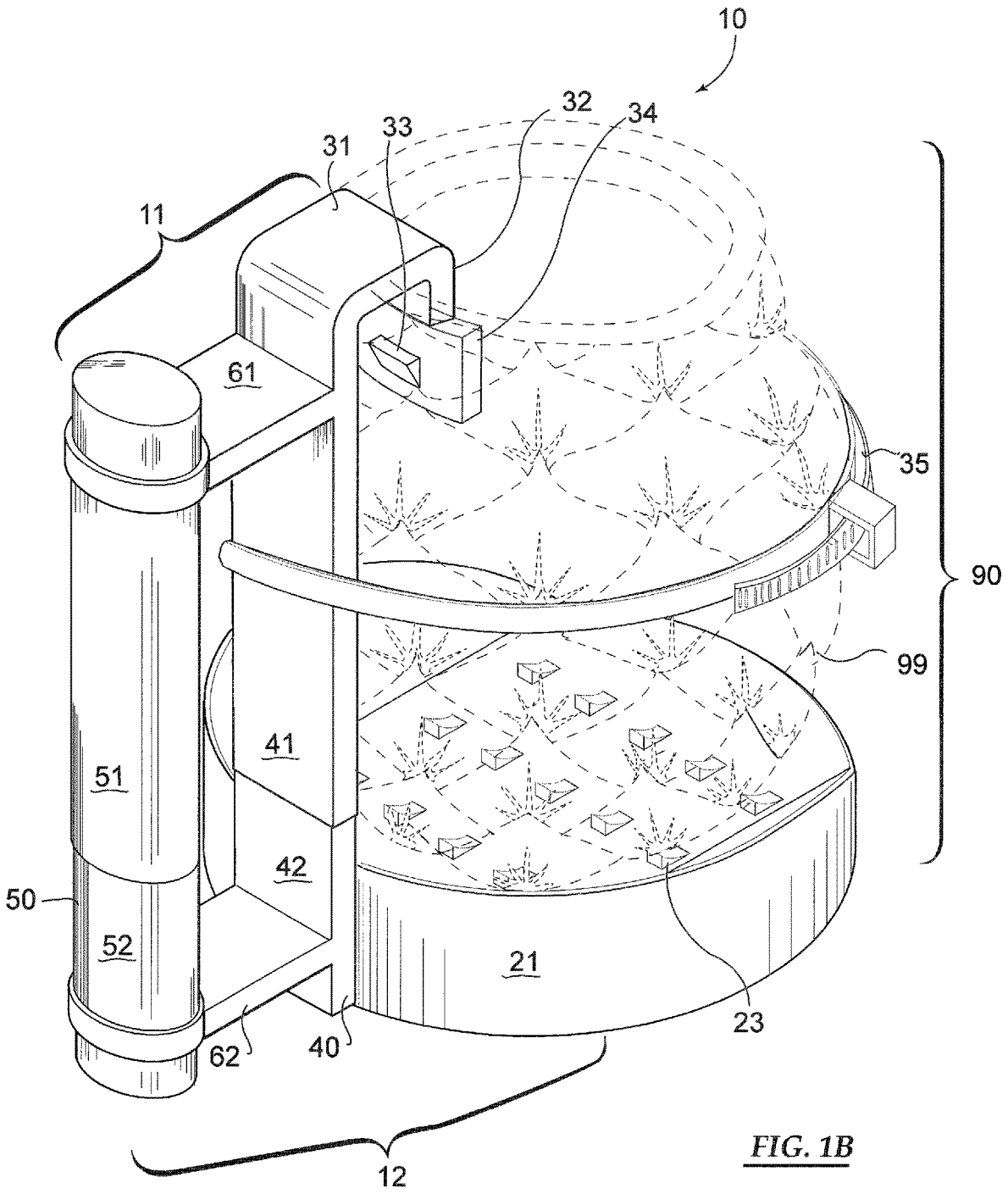
FIG. 1B is an isometric view of a first preferred attachment apparatus of the present invention with previously obscured components revealed.
Figure 1C:
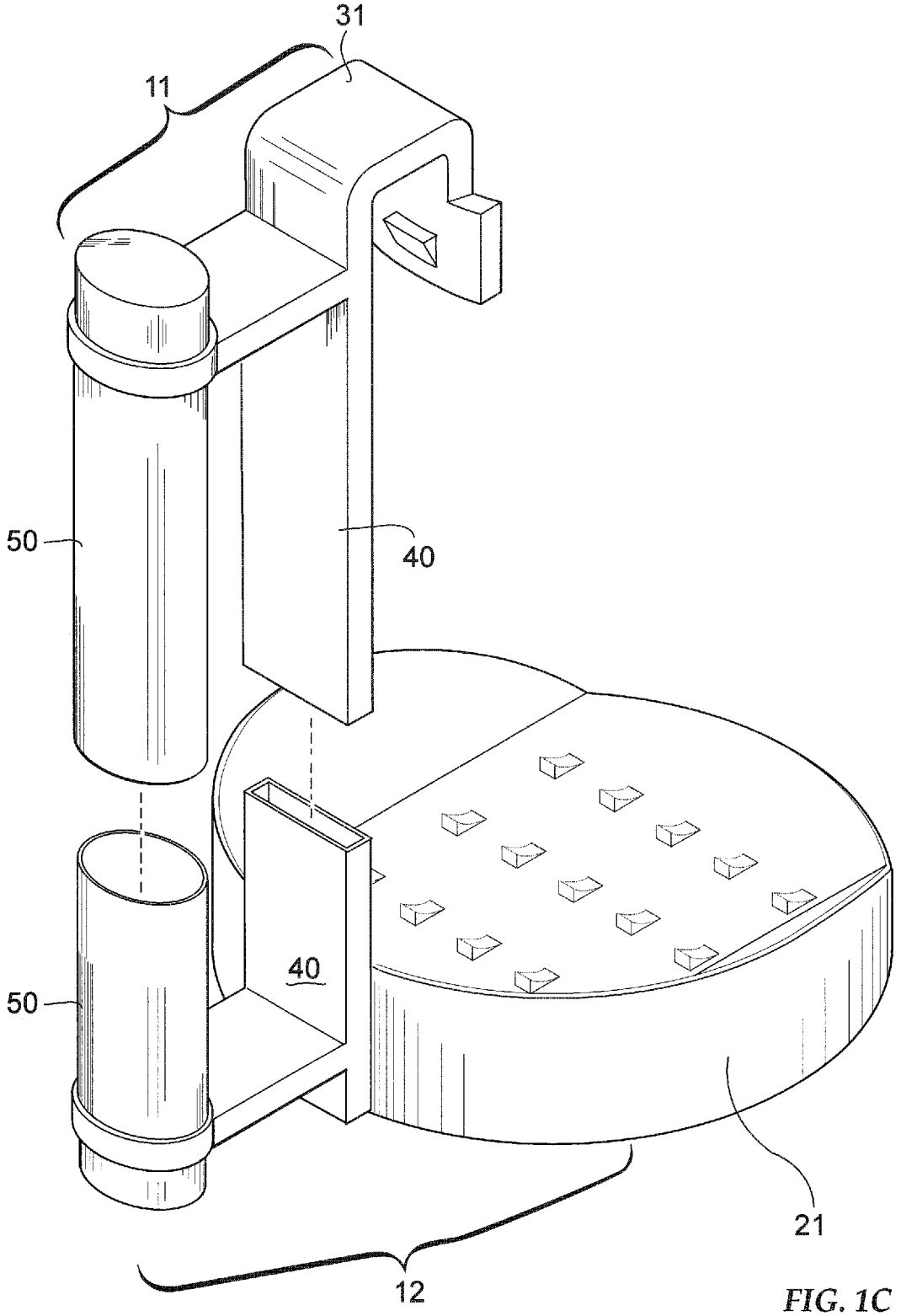
FIG. 1C is an additional isometric view illustration a separable invention mating together.

Further with reference to FIG. 1B and FIG. 1C, a cored-out pineapple 99 is cut to a predetermined height 90. As stated, the pineapple 99 can be slid across in and up into the attachment apparatus in one version. Or alternatively, as shown in the present, FIG. 1B and FIG. 1C, example, the apparatus may comprise upper half 11 and lower half 12 that clamp down on the pineapple 99. In this manner, an upper half 11 and a lower half 12 each oppose one another and secure the pineapple 99. More particularly, a U channel 30 subsequently clamps on a brim of the pineapple 99. The U channel has a curved portion 31 and an arm 32 extending down wherein tensile and compressive forces in the curved portion 31 and arm 32 provide means for tightly securing the pineapple. In an alternative embodiment, arm 32 extends farther down an inside wall of the pineapple 99 (than as shown in FIG. 1A and FIG. 1).

It should be appreciated that the drinking vessel 10 will swap out pineapples 99 after each use making easy attachment and removal important design aspects. Still further, the upper half 11 and lower half 12 are telescoping allowing for vertical height 90 adjustment at the vertical stanchion 40, providing versatility.

Still with regard to FIG. 1 B, securing strap 35 may either be optional or used in place of the U channel 30, Or the invention in an alternative embodiment, could have a vertical stanchion 40 with two straps 35 and no base plate 21 or U channel 30.

Figure 2:
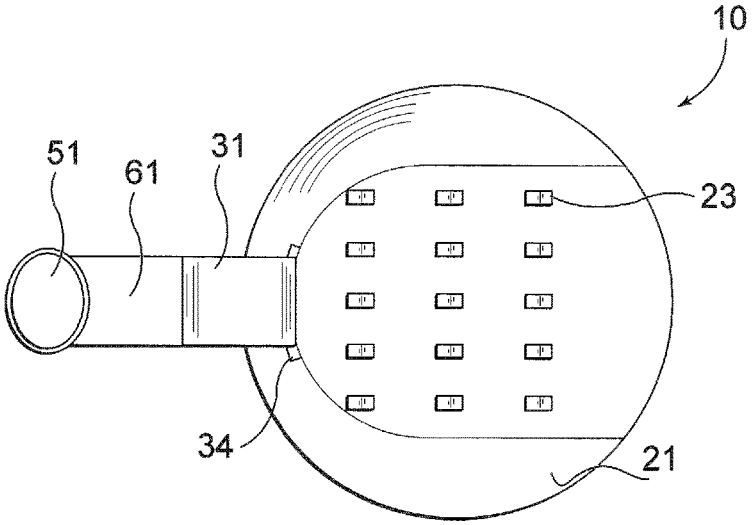
FIG. 2 is a top plan view of the attachment apparatus.

Further to FIG. 1 and FIG. 2, the vertical stanchion 40 comprises horizontal upper and lower spans 61, 62 extending outwardly, therefrom, with a mug handle 50 affixed, thereto. In a preferred embodiment, mug handle 50 comprises upper half 51 and lower half 52 which are telescoping. The area bound by horizontal upper and lower spans 61, 62, the vertical stanchion 40 and the handle 50 comprises a fingers gap for a hand of a user. As stated, compressive and tensile forces in the curved portion 31 of U channel hold the attachment apparatus in place. The configuration of the arm 32 also includes a curved end 34 that can mate next to a curved inside wall of a cored-out pineapple. The arm 32 and/or curved end 34 may also comprise a nub or tooth 33 (FIG. 1 B, FIG. 3) can further secure to the inside wall of pineapple 99. As stated, U channel 30 and its arm 32 extending down may secure a brim 91 of a pineapple 99.

Figure 3:
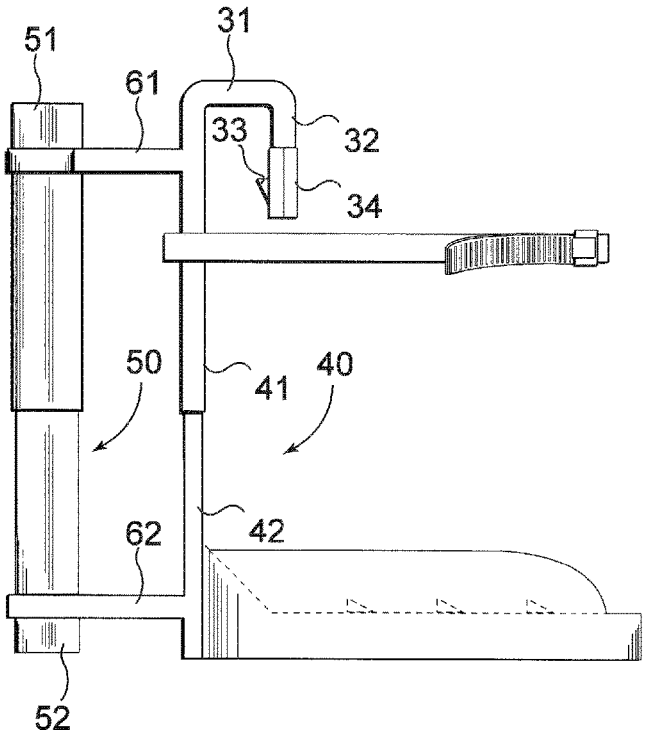
FIG. 3 is a side elevational view of the attachment apparatus.
Figure 4:
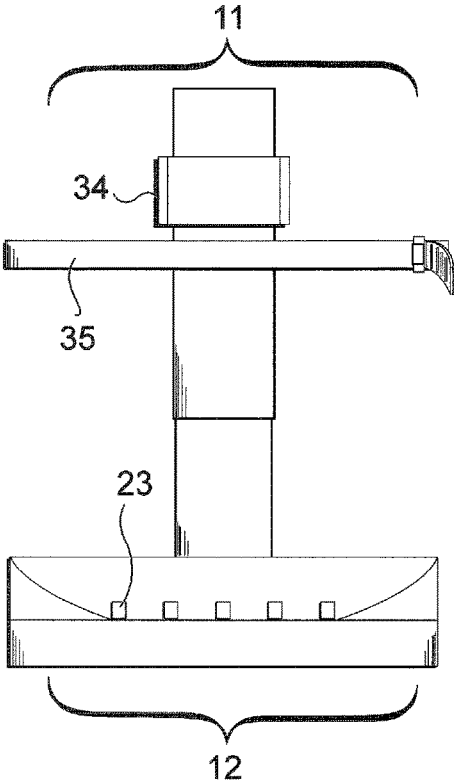
FIG. 4 is a front elevational view thereof.

Additionally, with reference to FIG. 1 B, FIG. 2, and FIG. 3, teeth or spikes 23 in the base plate 21 provide additional security arresting the pineapple 99 in place together with the attachment apparatus. In a preferred embodiment, the teeth 23 are angled inward toward the vertical stanchion 40 to allow some sliding in one direction i.e. placement of the pineapple 99, and hold in a reverse direction, i.e. pineapple remains secure. It is additionally contemplated that the base plate 21 or teeth 23 are hinged providing the same effect. Or the teeth 23 are hinged, or deflected, or have springs like one-way traffic spikes that allow tires to harmlessly roll past in one direction but puncture a tire in a reverse direction. The base plate 21 additionally provides a flat surface to rest and stabilize a drink. In an alternative embodiment, the handle 50 can arch down from the top of vertical stanchion 40 via horizontal upper span 61 without a horizontal lower span 62. The vertical stanchion 40 comprises upper and lower halves 41, 42 fitting together and securing the pineapple 99 at the brim 91 and a bottom surface.

In an additional aspect illustrated by FIG. 1A, FIG. 1B, FIG. 4, FIG. 5 and FIG. 6, the invention is a method of making a drinking vessel 10, the method comprising: providing a pineapple 99; cutting the pineapple to an appropriate height 90; coring out the pineapple 99; affixing a vertical stanchion 40 to a lateral side of the pineapple; attaching a handle 50 to the vertical stanchion thereby making the drinking vessel 10 a mug-type drinking vessel.

Figure 5:
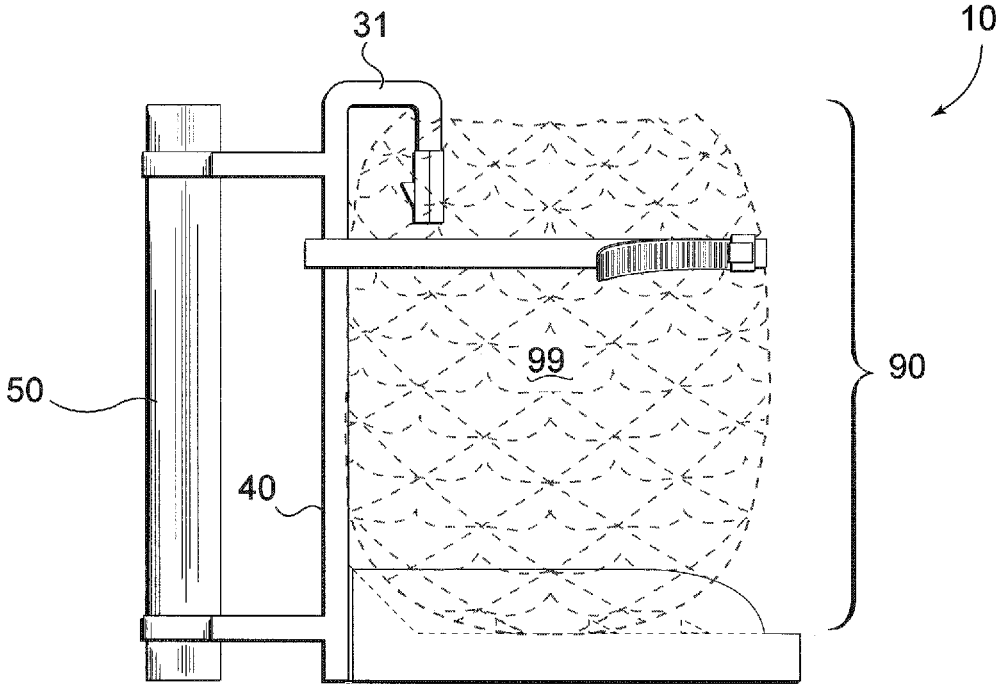
FIG. 5 is a side elevational view of the drinking vessel with a pineapple shown with dashed line to reveal obscured components.
Figure 6:
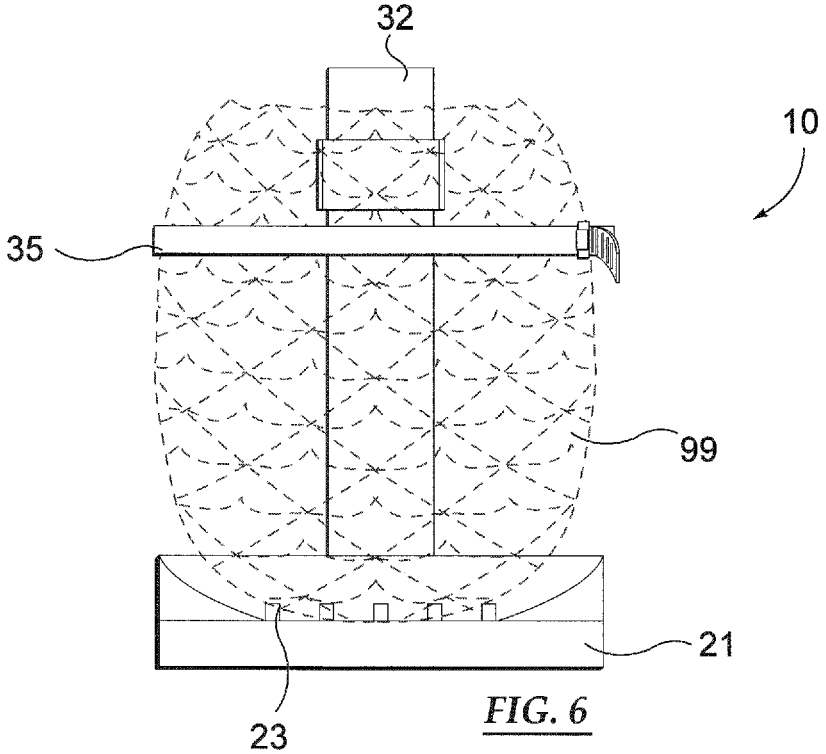
FIG. 6 is a front elevational view thereof.

As stated with reference to FIG. 2, FIG. 3, and FIG. 5, U-channel 30 has an arm 32 that extends down an inside wall of a pineapple 99. The arm has a curved end 34 having a curved surface that can mate with the inside wall underneath the brim 91. The base plate 21 has spikes 23 arranged in columns and rows; however, they 23 could be arranged in various configurations.

The method in this aspect is additionally characterized as the cutting the pineapple 99 to an appropriate height comprises a step of cutting the pineapple at 5 inches. However, in other embodiments height 90 may vary. Also, the invention is specifically described wherein the step of affixing a vertical stanchion 40 to a side of the pineapple 99 comprises the steps of: providing a U channel 30 inverted at a top of the vertical stanchion configured to fit around the brim of the pineapple; and providing a base plate 21 at a bottom of the stanchion 40, the U channel 30 together with the base plate 21 supporting the pineapple 99 at opposite ends thereby holding the vertical stanchion 40 and handle 50 in place.

Many alterations and modifications may be made by those having ordinary skill in the art without departing from the spirit and scope of the invention. Therefore, it must be understood that the illustrated embodiments have been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed above even when not initially claimed in such combinations.

While the particular Pineapple Drinking Vessel and Related Methods herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

We claim:

1. A drinking vessel comprising:

an individual hollowed out produce including a top surface being cut to a predetermined height;

a vertical stanchion positioned and secured at a lateral side of the individual produce;

a handle attached to the vertical stanchion thereby making the drinking vessel a mug drinking vessel;

a U-channel inverted at a top of the vertical stanchion, the U-channel configured around a brim of the individual produce at the top surface;

a base plate configured at a bottom of the vertical stanchion; and a plurality of spikes configured on a top surface of the base plate for gripping a bottom surface of the individual produce, the plurality of spikes angled in a direction towards the vertical stanchion to permit sliding in the direction while remaining secure in a reverse direction.

2. The drinking vessel of claim 1, wherein the predetermined height is approximately 5 inches.

3. The drinking vessel of claim 1, the U-channel further comprising an arm extending down an inside wall of the individual produce, the arm having a curved end for mating adjacent to the inside wall, the curved end having a spike to secure to the inside wall.

4. The drinking vessel of claim 1, further comprising a strap extending circumferentially around both of the individual produce and the vertical stanchion at an upper portion thereof.

5. The drinking vessel of claim 1, further comprising an upper and a lower horizontal span offsetting said handle and said vertical stanchion.

6. A drinking vessel comprising:

an individual produce including a hollowed out cored pineapple being open to receive liquid at an open top surface;

an attachment apparatus having upper and lower halves, the attachment apparatus comprising:

a U-channel inverted at the upper half;

a base plate at the lower half; and a vertical stanchion between the U-channel and the base plate, wherein the vertical stanchion comprises upper and lower halves fitting together and securing the individual produce at the open top surface and a bottom surface;

and wherein the U-channel is inverted at a top of the vertical stanchion, and further wherein the U-channel is configured around a brim of the individual produce at the open top surface;

wherein the base plate is configured at a bottom of the vertical stanchion;

and wherein the base plate further comprises a plurality of spikes configured on a top surface of the base plate for gripping the bottom surface of the individual produce, the plurality of spikes angled in a direction towards the vertical stanchion to permit sliding in the direction while remaining secure in a reverse direction.

7. The drinking vessel of claim 6, wherein the attachment apparatus upper and lower halves are telescoping thereby providing the attachment apparatus adjustable for varying heights of the individual produce.

8. The drinking vessel of claim 6, the attachment apparatus further comprising a handle offset from the vertical stanchion thereby making the drinking vessel a mug drinking vessel.

* * * * *